United States Patent [19]

Kukino et al.

[11] 4,084,383

[45] Apr. 18, 1978

[54] APPARATUS AND METHOD FOR MULTIPLE SPINDLE KNEADING FOR IMPROVING GROUND

[75] Inventors: Yoshinori Kukino; Mitsuo Miura, both of Tokyo; Hayao Aoyagi, Chiba, all of Japan

[73] Assignee: Takenaka Komuten Co., Ltd., Osaka, Japan

[21] Appl. No.: 744,990

[22] Filed: Nov. 26, 1976

[51] Int. Cl.[2] ..... E02D 3/12

[52] U.S. Cl. ..... 61/36 R; 61/63; 37/75; 366/301

[58] Field of Search ..... 61/36 R, 35, 63, 50, 61/36 B, 53.52, 36 A; 37/75, 77, 78; 259/99, 100, 102; 111/6

[56] References Cited

U.S. PATENT DOCUMENTS

| | | | |
|---|---|---|---|
| 410,198 | 9/1889 | Rieseck | 259/99 |
| 2,782,605 | 2/1957 | Wertz et al. | 61/36 R |
| 3,964,184 | 6/1976 | Mathieu | 37/195 |

*Primary Examiner*—Jacob Shapiro

[57] ABSTRACT

A plurality of agitation spindles are disposed, and an agitation vane is attached to the lower portion of each agitation spindle. A mixing and kneading zone for mixing and kneading soft soil with a hardener is formed so that the hardener is supplied near these agitation vanes. The agitation spindles are supported by reinforcing members and connecting members to construct a multiple spindle kneading apparatus for improving ground. In one embodiment, blade-like excavating cutters are mounted on the agitation spindles. In another embodiment, hollow agitation spindles are used and the hollow portions are used as hardener passages. In still another embodiment, a tube for injecting the hardener into the mixing and kneading zone is disposed so that it can be moved up and down. A method for hardening soft ground by using this multiple spindle kneading apparatus in which the hardener feed position can be changed is provided.

11 Claims, 29 Drawing Figures

A

B

C

D

APPARATUS AND METHOD FOR MULTIPLE SPINDLE KNEADING FOR IMPROVING GROUND

BACKGROUND OF THE INVENTION

This invention relates to a multiple spindle kneading apparatus for improving ground by which a hardener is kneaded in soft ground to harden the soft ground, and to a ground improving method using this kneading apparatus.

Kneading machines have heretofore been used for hardening soft soil layers accumulated in bottoms of harbors, bays, lakes, rivers and the like by adding a hardener into these soft soil layers without shifting them from the accumulated positions and kneading the hardener into the soil layers under agitation. Since these soft soil layers are located deeply below the water surface, the total length of an agitation spindle provided with agitation vanes is 30 to 40 m. Accordingly, in the conventional kneading machines, agitation spindles shake violently during the operation and troubles are readily caused by collision of agitation vanes or excentric rotation of agitation vanes. In order to prevent such shaking of agitation spindles, the kneaders are often operated at a low speed. In this case, however, the agitation effect is drastically reduced.

Soft soil layers to be improved have much lower water contents than sludge deposit layers and hence, they have much higher viscosities. Further, the basic ground strength is relatively high in many cases. In conventional kneaders, the kneading zone is constructed by agitation vanes and projecting pilot blades. Accordingly, when the kneading zone is pierced into the soft soil layer, the soft soil, i.e., the soil to be improved, adheres to the pilot blades to wrap them. As hardening of the soil by the hardener is advanced, this soil adhesion phenomenon is enhanced and the amount of the adhering soil is increased. Therefore, the piercing speed is drastically lowered when the kneader is pierced in the soft soil layer and a large power is required for this piercing operation. In an extreme case, piercing per se becomes impossible.

In the conventional kneading machines, a hardener is injected to the kneading zone of the agitation spindle from (1) a hardener injection opening disposed above the kneading zone or (2) a hardener injection opening disposed below the kneading zone.

In case of (1), since the hardener is not supplied to the lower portion of the kneading zone, disturbed non-improved soil is left in the lower end portion of the improved soil layer and no sufficient supporting strength is given to the hardened improved soil layer. In case of (2), the soil layer is kneaded effectively with the hardener, but since by injection and kneading of the hardener the properties of the original ground are rapidly changed in a short time, the rotation load imposed on the agitation spindle is drastically increased and also a resistance to piercing or withdrawal of the kneading machine is enhanced.

As the conventional ground-improving method, there can be mentioned (a) a method in which a hardener is injected while a kneading machine is pierced into the ground and kneading is carried out when the kneading machine is pierced into the ground and when the kneading machine is withdrawn from the ground, and (b) a method in which a hardener is not injected while a kneading machine is pierced into the ground but is injected when the kneading machine is withdrawn from the ground and kneading is carried out during this withdrawal operation.

According to the method (a), the properties of the original ground are rapidly changed in a short time by injection and kneading of the hardener, and the rotation load imposed on the agitation spindle is drastically increased and also a resistance to piercing or withdrawal of the kneading machine is enhanced. According to the method (b), since kneading of soft soil with the hardener is performed when the kneading machine is withdrawn from the soil layer, a long time is required for completing the withdrawal operation and the operation efficiency is very low. Moreover, since soft soil is kneaded with the hardener when the kneading machine is withdrawn from the soil layer, no substantial kneading effect can be attained if the hardener is injected from the lower portion of the kneading zone. Therefore, the hardener must be supplied from the upper portion of the kneading zone, and disturbed non-improved soil is left in the lower end portion of the improved soil layer. As a result, no sufficient supporting strength is obtained and subsidence of the improved soil layer is caused to occur.

SUMMARY OF THE INVENTION

It is therefore a primary object of the present invention to provide a ground improving kneading apparatus in which a plurality of agitation spindles are rotatably supported by reinforcing members and connecting members so that shaking of the agitation spindles is prevented when they are rotated.

Another object of the present invention is to provide a ground improving kneading apparatus in which blade-like excavating cutters are attached to lower portions of agitation vanes to perform piercing of the kneading zone into a soft soil layer rapidly in a very short time.

Still another object of the present invention is to provide a ground improving kneading apparatus in which hollow agitation spindles are provided and hardener passages are formed in the hollow portions of the agitation spindles, whereby provision of conduits for supplying the hardener to the kneading and agitation zone is made unnecessary.

A further object of the present invention is to provide a ground improving kneading apparatus in which tubes for injection of a hardener and agitation vanes of a plurality of agitation spindles are disposed vertically movably and rotatably so that these agitation vanes do not interfere with one another, whereby the hardener is uniformly supplied to the entire of a soft soil layer.

A still further object of the present invention is to provide a ground improving method in which the lower end portion of a soil layer to be improved is first subjected to the hardening treatment and the remaining portion of the soil layer is then subjected to the hardening treatment, whereby a good hardened condition is attained throughout the soil layer from the lower end portion to the upper end portion thereof.

DETAILED DESCRIPTION OF THE PREFERRED EMBODIMENTS

The present invention will now be described in detail by reference to the accompanying drawings.

Figure 1:
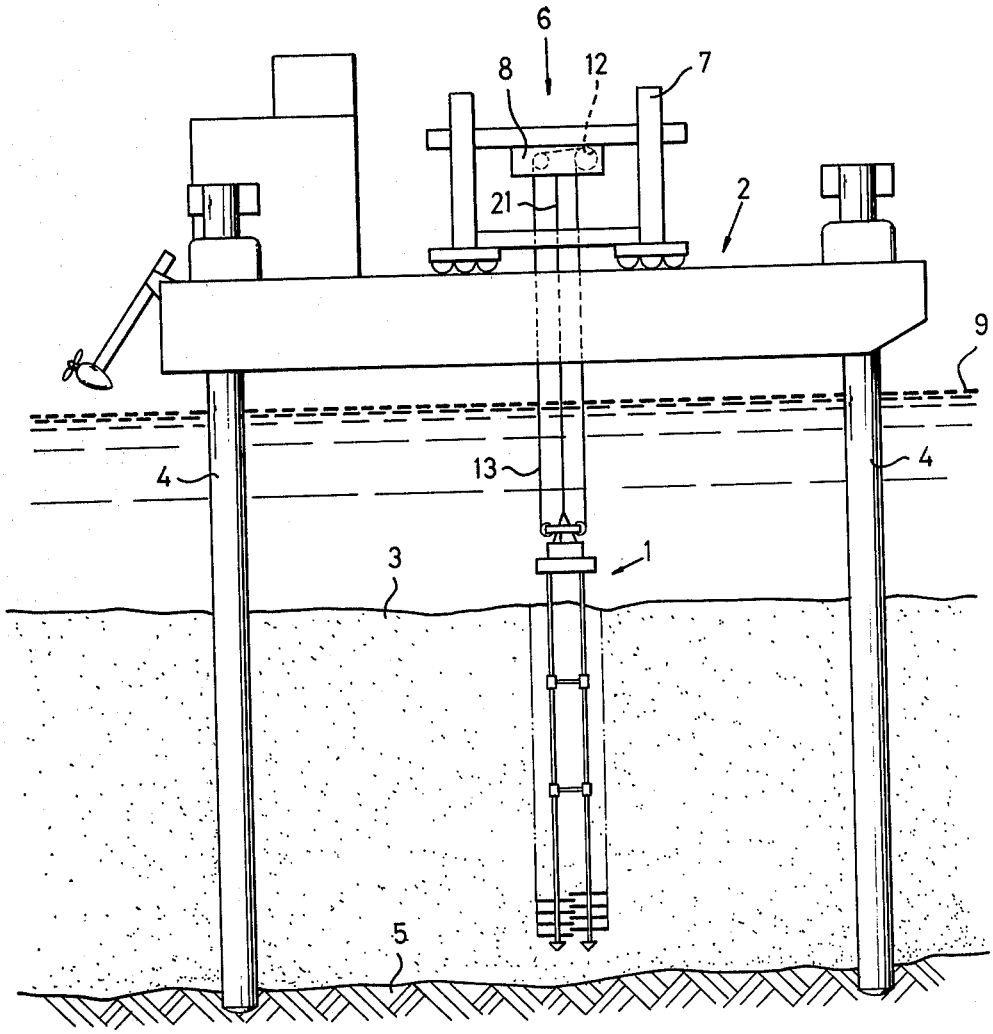
FIG. 1 is a diagram illustrating the operation state of the kneading apparatus of the present invention.

Referring now to FIG. 1, the kneading apparatus 1 of the present invention is hung from a working station 2 on the ground to be improved, and a soft soil layer 3 is hardened in succession. The working station 2 is fixed to the supporting base ground 5 by poles 4, and a hanging device 6 for hanging down the kneading apparatus 1 can be shifted by an advancing and retreating device 7. Further, a device 8 for moving the kneading apparatus 1 right and left is disposed on the hanging device 6. By this arrangement, the kneading apparatus 1 is alloweded to shift to an optional position below the operation stand 2. Reference numeral 9 represents the water surface.

Figure 3:
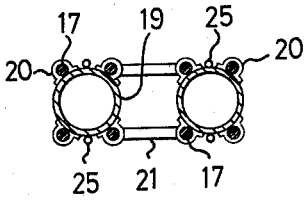
FIG. 3 is a view showing the section taken along the line III—III in FIG. 2.
Figure 4:
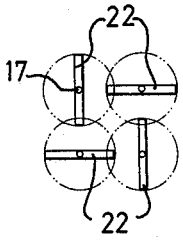
FIG. 4 is a view showing the section taken along the line IV—IV in FIG. 2.

The kneading apparatus 1 will now be described by reference to FIGS. 2, 3 and 4.

A frame 10 is mounted on the upper portion of the kneading apparatus 1, and a wire rope 13 of a hanging member 12 mounted on the hanging device 6 is laid on a pulley 11 attached to the frame 10, so that the kneading apparatus 1 is moved up and down by driving of the hanging member 12. A rotating and driving mechanism 16 including a hydraulic motor 14 and a reduction gear 15 is mounted on the lower portion of the frame 10 and an agitation spindle 17 is connected to the output shaft of the reduction gear 15 through a shaft coupling. In this embodiment, four agitation spindles 17 are driven by one reduction gear 15, and the kneading apparatus 1 includes five driving mechanisms 16 having the above structure. These driving mechanisms 16 are connected to one another through connecting plates 18 which are attached and fixed by clamping means such as bolts and nuts. Four agitation spindles 17 driven by one reduction gear 15 are supported on the periphery of a cylinder 19 having the substantially same length as those of the spindles 17 except the lower portion thereof, through bearings 20. The cylinder 19 is supported on the lower portion of the reduction gear 15. Each agitation spindle has a length of about 30 to about 40 m and is supported by about ten bearings 20.

By this arrangement, the four agitation spindles 17 can be held assuredly in parallel to one another. In order to hold these spindles 17 in parallel to agitation spindles 17 held by other cylinders 19, corresponding bearings 20 of every two adjacent cylinders 19 are connected to each other through a connecting member 21. Two agitation vanes 22 for agitating soft soil and the like are attached to each agitation spindle 17 at the positions below the cylinder 19, and every two adjacent vanes are spaced from each other in the axial direction so that they do not touch to agitation vanes 22 attached to other agitation spindles 17. The reduction gear 15 is set so that rotation directions of the four agitation vanes 22 are synchronous and opposit each other, whereby generation of a twisting force by rotation of the four agitation spindles 17 is prevented. These agitation vanes 22 form a kneading zone 23, and a piloting cutter 24 is attached to the lower end of each agitation spindle 17. Injection tubes 25 for supplying a hardener to the kneading zone 23 are mounted to two portion of facing each other or four portion of every intervals of four agitation spindles in the outside of the cylinder 19. The upper portion of the tube 25 is connected to a hardener supply source through a hose 26 and the lower end of the tube 25 is projected slightly from the lower end of the cylinder 19 to form a hardener injection opening 27. In the present embodiment, the cylinder 19 holding agitation spindles 17 thereon had a circular section, but it may have a square section. Further, the number of agitation spindles 17 driven by one reduction gear 15 is not limited to 4, but an optional number of the spindles 17 may be driven by one reduction gear 15. At any rate, a group of the spindles 17 driven by one reduction gear 15 are supported on one cylinder 19.

When the kneading apparatus 1 having the above structure is pierced into a soft ground or used for kneading soft soil or the like, although the agitation spindles are very long, since they are tightly held and supported by the cylinders 19 or connecting members 21, they are prevented from shaking. Therefore, collision of the agitation vanes 22 is effectively prevented and occurrence of troubles by mechanical damages owing to excentric abrasion in bearings 20 is also prevented. Further, since shaking of the agitation spindles 17 is prevented, the kneading apparatus can be pierced vertically. As a result, no excessive power is required for driving the agitation spindles and soft soil can be mixed and kneaded with a hardener under prescribed good conditions.

Another embodiment of the kneading apparatus of the present invention will now be described by reference to FIG. 5.

In this embodiment, agitation spindles are held by reinforcing members 30 and connecting members 31 described below instead of the cylinders 19 used in the above-mentioned first embodiment. The entire length of the agitation spindle 17 except the kneading zone 23 is wrapped with a reinforcing member 30 composed of a pipe or a tubular member having an L-shaped or U-shaped section, and the agitation spindle 17 is rotatably supported at suitable positions in the interior of the reinforcing member 30 by means of rollers or bearings. The reinforcing members 30 are connected to one another by connecting members 31 such as iron rods, pipes and angles, and some of these connecting members 31 are inclined in reverse directions and the other connecting members 31 are disposed horizontally, so that a truss structure is formed by these connecting members 31. Also in this embodiment, one group of four agitation spindles 31 are held in parallel to one another by such connecting members 31. Four agitation spindles 17 forming one group are connected to one another by the connecting members 31, and groups of the agitation spindles 17 are held by the reinforcing members 30 and these reinforcing members 30 are connected to one another by reinforcing plates 32. The four agitation spindles 31 are preferably disposed at the corners of a square.

In the present embodiment, the agitation spindle 17 has a hollow structure and a passage for a hardener is formed in the interior hollow portion. The top end of the agitation spindle 17 is connected to a hardener supply source through a pipe 32 and a hardener injection opening 33 is formed in the kneading zone 23 of the agitation spindle 17. Other structures and functions are the same as in the embodiment shown in FIG. 2, and members having the same structure and function are indicated by the same referential numerals as used in FIG. 2.

Also in the present embodiment, long agitation spindles 17 are held and supported by reinforcing members 30, connecting members 31 and reinforcing plates 32, and they are prevented from shaking during the operation. Accordingly, the same effects as attained in the embodiment shown in FIG. 2 can also be attained in this embodiment. Since a hardener is supplied through the hollow portion of the agitation spindle 17, a hardener injection tube for feeding the hardener to the kneading zone 23 need not be provided separately. The embodiment where the hollow portion of the agitation spindle 17 is used as the passage for a hardener will hereinafter be detailed.

Figure 2:
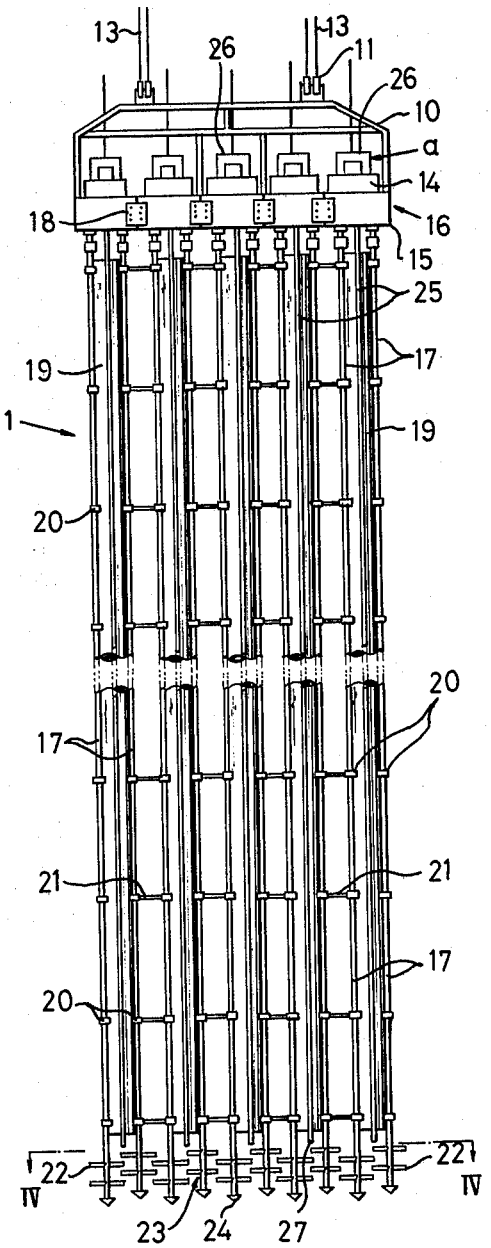
FIG. 2 is a front view of one embodiment of the multiple spindle type kneading apparatus of the present invention.
Figure 5:
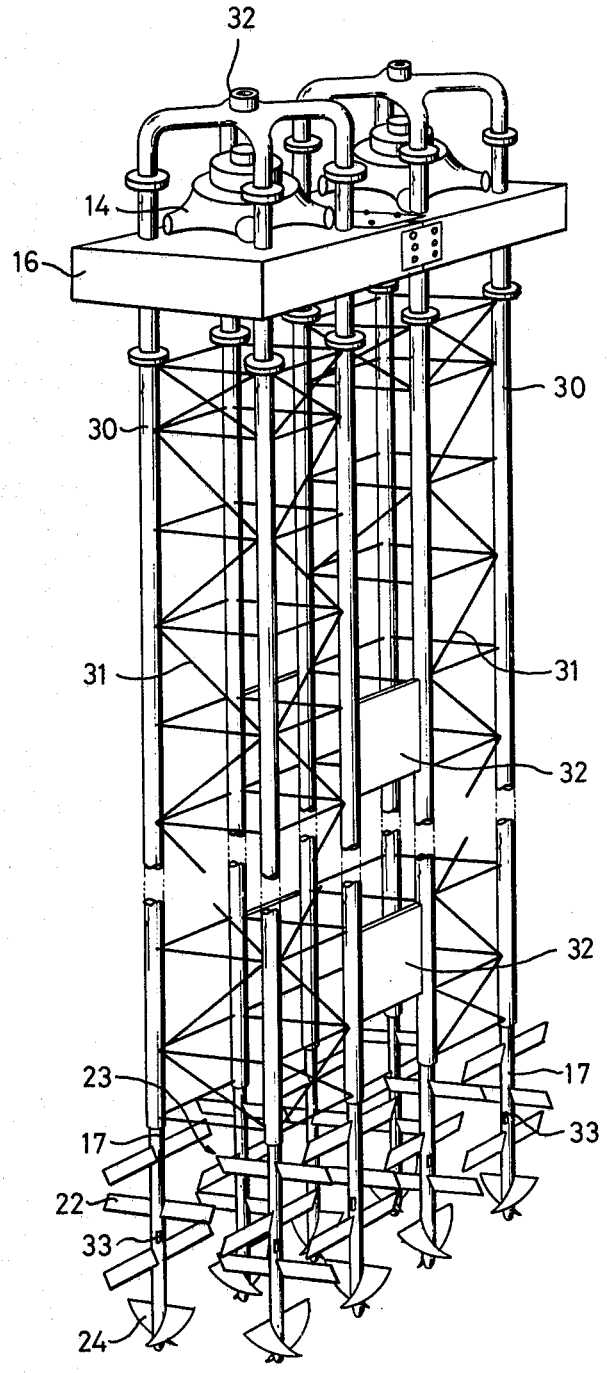
FIG. 5 is a perspective view of another embodiment of the multiple spindle type kneading apparatus of the present invention.

Of course, in the embodiment shown in FIG. 5, injection tubes 25 used for supply of a hardener, such as shown in FIG. 2, may be provided independently.

Figure 6:
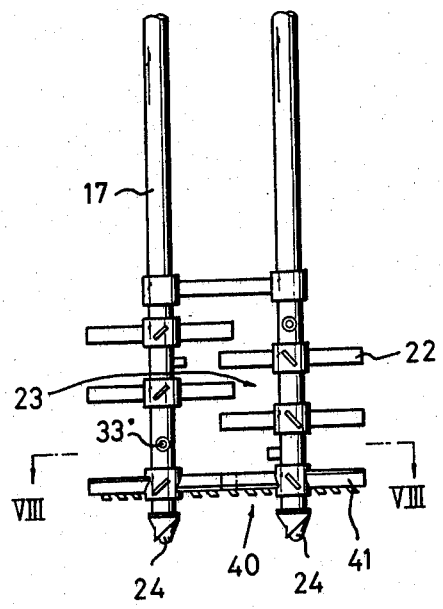
FIG. 6 is a partially enalrged view of the kneading zone of the kneading apparatus of the embodiment shown in FIG. 5.
Figure 7:
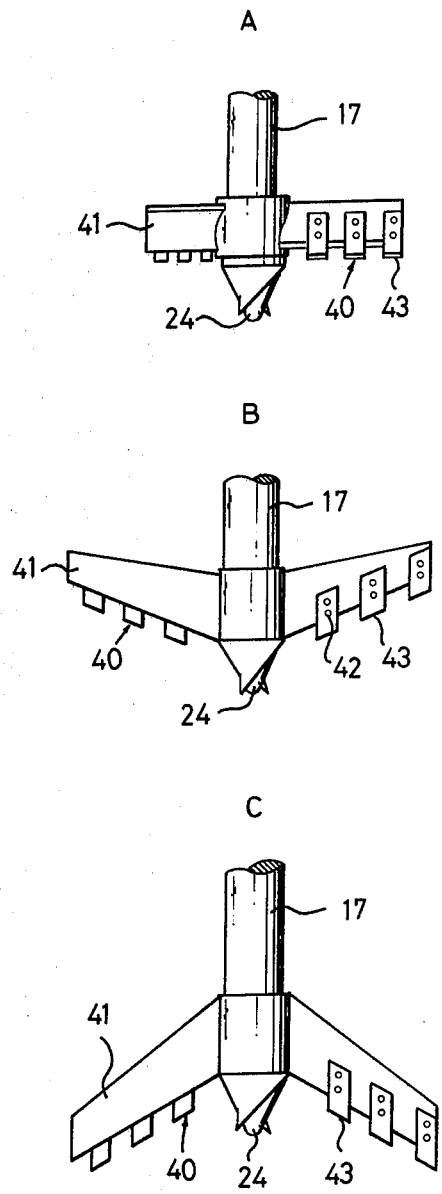
FIGS. 7-(A) and 7-(B) are front views showing examples of a blade-like excavating cutter.

An embodiment where blade-like excavating cutters 40 are attached to the lower end portions of agitation spindles 17 to facilitate piercing of the kneading apparatus 1 into soft ground will now be described by reference to FIGS. 6 to 8.

In each agitation spindle 17, a blade-like excavating cutter 40 is disposed between a piloting cutter 24 attached to the lower end of the spindle 17 and an agitation vane 22 mounted in the kneading zone 23. The excavating cutter 40 includes about three attachment stands 41, and blades 43 are fixed to each attachment stand 41 by fixing means 42 such as bolts. The radius of the excavating cutter 40 is substantially equal to the radius of the agitation vane 22. It is possible to mold the blades 43 and attachment stand 41 integrally and subject only the blades 43 to the hardening treatment. The angle between the attachment stand 41 and the agitation spindle 17 may be 90° as shown in FIG. 7-(A), or the attachment stand 41 may be inclined upwardly with respect to the agitation spindle 17 as in FIG. 7-(B) or inclined downwardly with respect to the agitation spindle 17 as in FIG. 7-(C). An appropriate arrangement is selected and adopted depending on the properties of the soil layer to be hardened and other conditions.

The agitation spindle 17 has a hollow structure to form a passage for a hardener, and an injection opening 33' is formed below the agitation vane.

The state of attachment of blades 43 to the attachment stand 41 will now be described by reference to FIG. 8.

Figure 8:
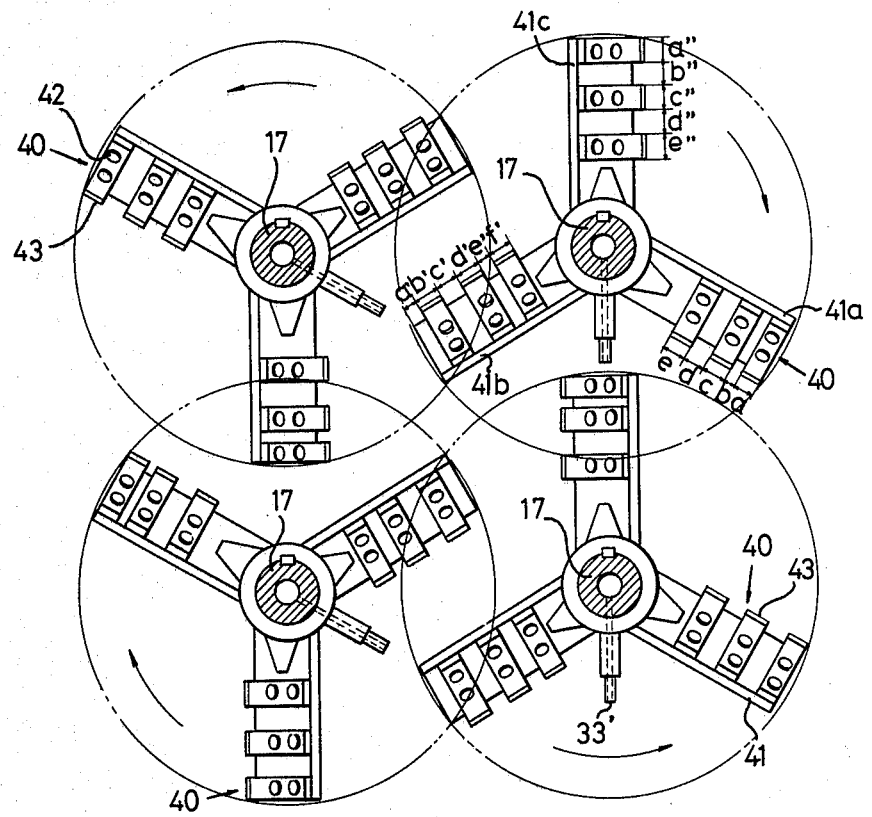
FIG. 8 is a view showing the section taken along the line VIII—VIII in FIG. 6.

Three blades 43 are mounted on each of the three attachment stands 41*a*, 41*b* and 41*c*, and the widths and spacings of the blades 43 are adjusted to *a, b, c, d* and *e*, or $a' - f'$ or $a'' - e''$ as shown in FIG. 8.

The length ratio of *a:b:c:d:e* is 3:1:3:3:3, the length ratio of $a' - f'$ is 2:3:3:3:2:3 and the length ratio of $a'' - e''$ is 3:3:3:3:3. In short, these pipe blades 43 attached to the three attachment stands 41*a*, 41*b* and 41*c* are arranged so that loci of the nine blades 43 overlap slightly one another. By this arrangement, soft ground can be excavated uniformly and abrasion of the edge of each blade 43 is prevented.

When the kneading apparatus 1 provided with the above-mentioned excavating cutters 40 is employed, even if ground to be improved has a high strength, these excavating cutters 40 advance ahead of agitation vanes 22 and excavate soil layers to be improved over a range substantially equal to the range to be agitated by the agitation vanes 22, and therefore, the piercing speed of the kneading apparatus 1 can be remarkably enhanced. In this embodiment, the excavating cutters 40 have also a function of agitating soft soil and accelerating kneading of soft soil with a hardener. As a result, the power for rotating the agitation spindle 17 can be remarkably reduced.

Figure 9:
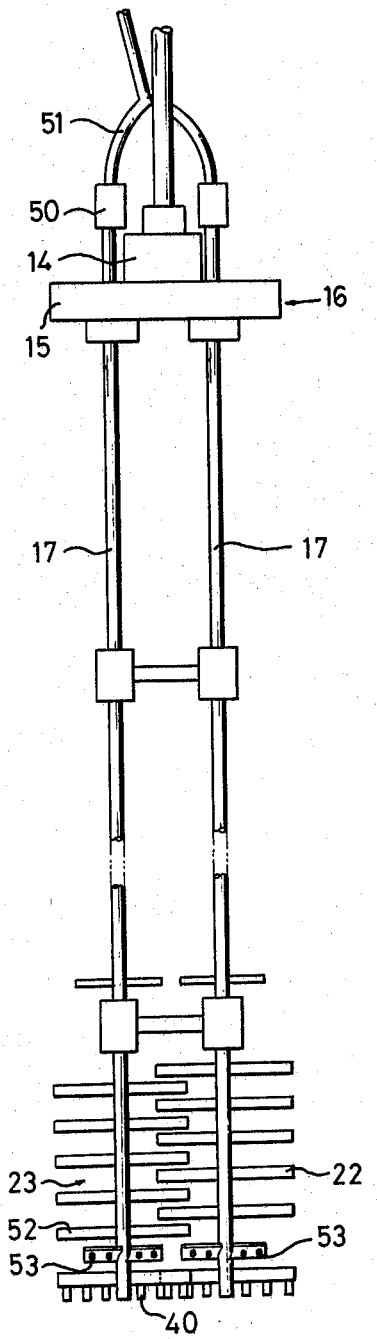
FIG. 9 is a front view of still another embodiment of the kneading apparatus of the present invention in which a hardener passage is formed in the interior of the agitation spindle.

An embodiment where hollow agitation spindles 17 are used and passages for a hardener are formed in the hollow interiors of the spindles 17 will now be described by reference to FIG. 9.

In the upper portion of the kneading apparatus 1 hung down by a wire rope, a motor 14 and a reduction gear 15 are disposed to form a driving zone 16. Agitation spindles 17 are connected to the lower portion of the reduction gear 15, and in the lower portion of each spindle 17 an agitating and kneading zone 23 including agitation vanes 22 and blade-like excavating cutters 40 is formed. The agitation spindle 17 has a hollow structure, and the top end of the spindle 17 is projected upwardly beyond the reduction gear 15 and is connected to a hardener injection pipe 51 through a swivel joint 50. This injection pipe 51 is connected to a hardener supply source. Two boom passages 52 are formed between the agitation vanes and the excavating cutters 40 disposed on the lower end of the spindle 17, and these boom passages 52 are communicated with the hollow portion of the spindle 17. A plurality of injection openings 53 are formed on each boom passage 52. The length of the boom passage 52 is made shorter than the length of the agitation vane 22 so that the hardener injected from the injection openings 53 can easily be supplied to the agitation vane 22 from the periphery of the circular arc defined by the boom passage 52.

In the present embodiment, a special injection pipe need not be provided independently to feed a hardener to the kneading zone 23 of the kneading apparatus 1. Therefore, no space is taken into consideration for such injection tube in assembling the kneading apparatus 1, and the structure can be simplified and the weight is reduced, whereby transportation of the kneading apparatus 1 can be remarkably facilitated. Since the boom passage 52 having injection openings 53 formed thereon are rotated, a hardener can be supplied uniformly to soft soil at a high efficiency.

An embodiment in which a hardener injection tube is disposed vertically movably so that the position for feeding a hardener to the kneading zone 23 can be changed will now be described by reference to FIG. 10.

Figure 11:
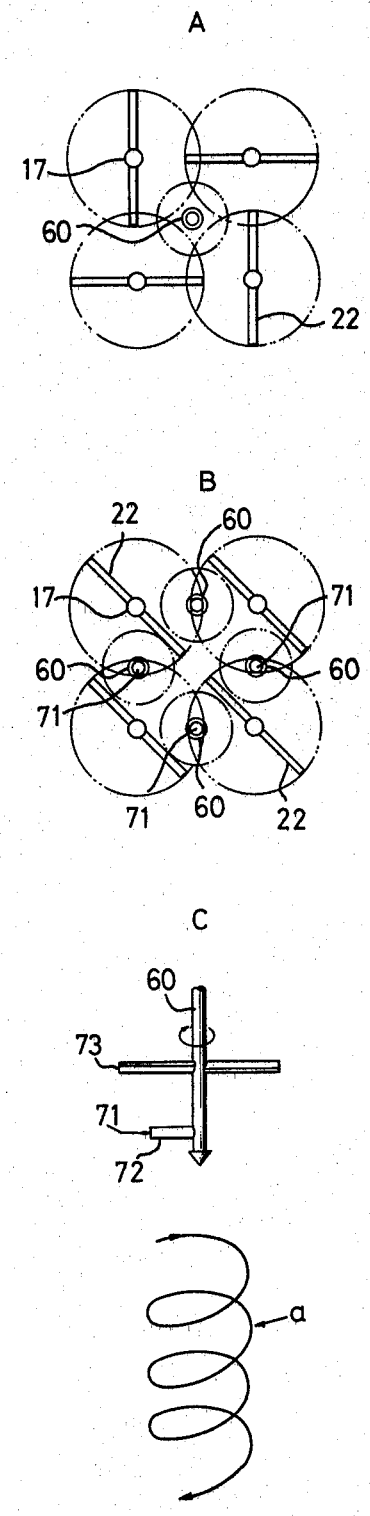
FIGS. 11-(A), 11-(B) and 11-(C) are diagrams showing the states of supply of a hardener in the kneading apparatus shown in FIG. 10.

A hardener injection tube 60 is supported below the driving zone 16 of the agitation spindle 17 by a driving mechanism 61 for vertically moving the tube 60. This driving mechanism 61 includes a hydraulic cylinder 62, and a rotating and driving mechanism 63 for the injection tube 60 is fixed to the lower end of the cylinder 62. The range along which the driving mechanism 61 shifts in the vertical direction has a length substantially equal to the length of the kneading zone 23. The rotating and driving mechanism 63 includes a motor 65 and a reduction gear 66, and the output shaft of the reduction gear 66 is connected to the injection tube 60 through a joint. The injection tube 60 is formed to have a hollow structure, and a swivel joint 67 mounted on the top end of the injection tube 60 is connected to a hardener supply source through a hose 68. The lower end of the injection tube 60 is located in the upper portion of the kneading zone, and several parts of the intermediate portion of the injection tube 60 are held through bearings 70 on a frame 69 supported on the agitation spindle 17. A lateral tube 72 having a hardener injection opening 71 on the top end thereof is attached to the lower end of the injection tube 60, and a hardener is fed to the injection opening 71 from the injection tube 60. The injection opening 71 is provided at the portion where the agitation vanes 22 are overlaped. Two disturbing vanes 73 composed of a hard material are mounted above the lateral tube 72 to roughly agitate the the hardener injected in soft soil. The length of the lateral tube 72 is made a little smaller than the length of the agitation vane 22. One injection tube 60 having the above structure may be disposed at the center of a group of four agitation spindles 17 as shown in FIG. 11-A, or four injection tubes 60 may be disposed for such group of four agitation spindles 17 as shown in FIG. 11-B. In the case of FIG. 11-B, every injection opening 71 is formed at a portion that adjacent agitation vanes 22 are overlap each other. In each case, the reduction gear 15 is set so that the agitation vanes 22 do not interfere with lateral tubes 72 or disturbing vanes 73 (see FIGS. 11-A and 11-B), and after the reduction gear 15 has thus been set, the vertical movement of the injection tube 60 is initiated.

When the kneading apparatus 1 provided with the above-mentioned injection tubes 60 capable of vertical movement is employed, the agitation spindle 17 is driven while maintaining the injection opening 71 above the agitation vane 22, whereby the kneading apparatus 1 is pierced into ground. At this point, a hardener is not supplied but the soil layer to be improved is agitated. Then, driving of the agitation spindle 17 is stopped, and the hardener is fed under pressure to the injection tube 60 from the hardener supply source. While the hardener is being injected from the injection opening 71, the rotating and driving mechanism 63 is started, and while the injection tube 60 is being rotated and driven, the driving member 61 is started to bring down the injection tube 60 so as to inject and supply the hardener into the kneading zone 23. The injection opening 71 is located at a position deviated from the center of rotation of the injection tube 60 by a length corresponding to the length of the lateral tube 72. Accordingly, the hardener is injected and supplied to the kneading zone 23 along a spiral course as shown in FIG. 11-C. Further, since also the disturbing vane 73 is rotated, the thus supplied hardener is roughly scattered into the agitated soft soil. Accordingly, occurrence of an undesired phenomenon caused when the hardener is injected to the lower end portion of the soil layer to be improved after stopping of the kneading apparatus 1, namely a phenomenon that the hardener tends to rise along the injection tube 60, is effectively prevented, and as a result, the hardener is fed to the agitated soil layer under prescribed good conditions.

When the hardener is injected even up to the lower end of the kneading zone 23 in the above-mentioned manner, injection of the hardener is stopped, and while rotation of the injection tube 60 is continued or after rotation of the injection tube 60 has been stopped, the injection tube 60 is lifted up by the driving member 61 until the injection opening is located above the agitation vane 22, and the operation of lifting up the injection tube 60 is stopped. Then, the agitation spindle 17 is driven and rotated again to knead the lower end portion of the soil layer to be improved, and thus, this lower end portion of the soil layer is subjected to the hardening treatment. Further, while the hardener is being injected from the injection opening 71 located above the kneading zone 23, the kneading apparatus 1 is drawn up, and during this drawing-up operation, the soil layer is kneaded and hardened even up to the top end of the soil layer. This kneading and hardening treatment may be carried out in the state where the rotation of the injection tube 60 is stopped. However, if this treatment is carried out while rotating and driving the injection tube 60, since the hardener can be supplied in a broad range as in the case shown in FIG. 11-C, the kneading operation can be accomplished at a further enhanced efficiency.

As is seen from the foregoing illustration, in the present invention, the hardener can be injected and supplied uniformly throughout the soil layer to be improved. Further, after injection of the hardener, the soil layer can be kneaded with the hardener sufficiently in a very short time. Accordingly, the kneading apparatus is allowed to be withdrawn in the early stage of hardening in the soil layer, and hence, a resistance to withdrawal of the kneading apparatus is low and the ground can be improved with the use of a reduced power. In short, a power-saving effect can be attained. Moreover, since the lower portion of the soil layer is first hardened, a sufficient strength can be attained by the hardening treatment.

Figure 10:
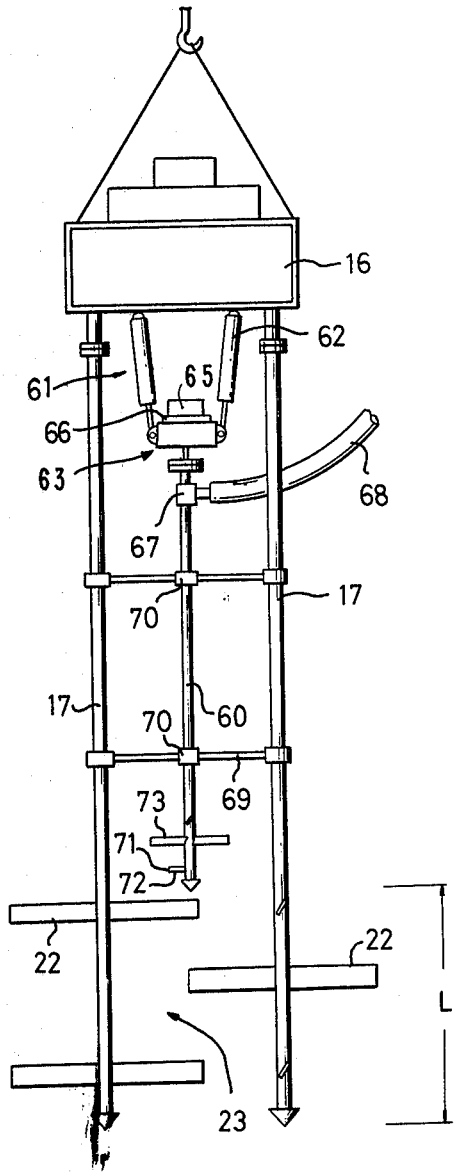
FIG. 10 is a front view of a further embodiment of the kneading apparatus of the present invention in which a hardener injection tube is disposed vertically movably and rotatably.

Although the feed position of the hardener can be changed in the vertical direction in the embodiment shown in FIG. 10, the present invention also includes an embodiment in which the hardener is supplied at upper and lower two positions. This embodiment will now be described by reference to FIG. 12.

The agitation spindle 17 has a hollow structure, and a passage for a hardener is formed in the hollow portion of the spindle 17. The top end of the agitation spindle 17 is projected upwardly over the reduction gear 15 and connected to a hardener supply source 84. A hardener injection opening 80 is formed in the lower portion of the agitation spindle 17. This opening 80 may be formed directly on the spindle 17 or may be formed on a boom passage 52. A hardener injection tube 81 is held by a holding frame 83 at the center of a group of four agitation spindles 17. The top end of the hardener injection tube 81 is connected to the hardener supply source 84 and a hardener injection opening 82 formed on the lower end of tube 81 is located above the agitation vane 22. Feeding of the hardener from the injection opening 80 or the injection opening 82 is performed selectively by a change-over control device 85 including a change-over valve or the like, which is mounted on the hardener supply source 84.

Figure 12:
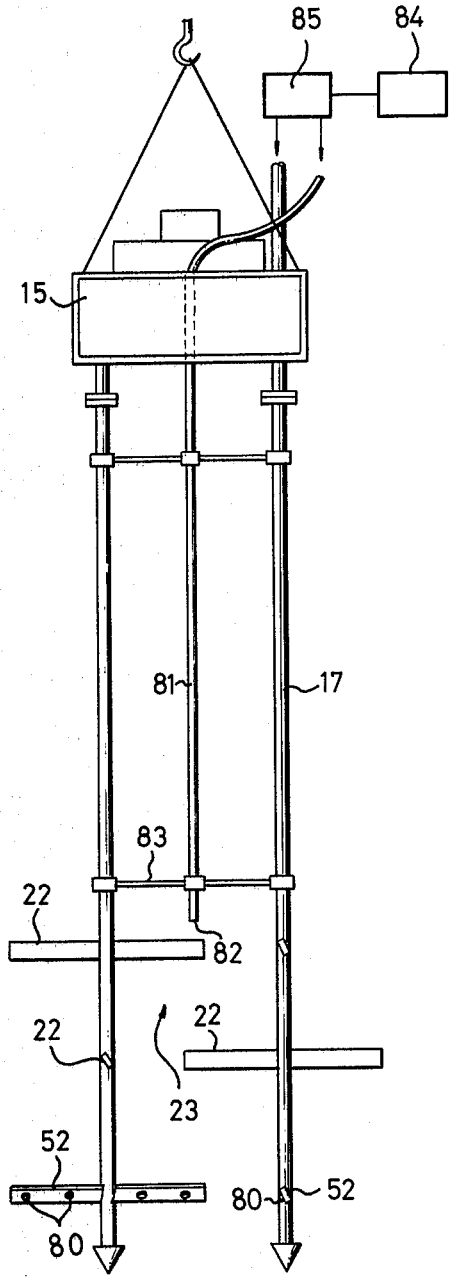
FIG. 12 is a front view of a still further embodiment of the kneading apparatus of the present invention in which a hardener is supplied from upper and lower two points.

In the case where the kneading apparatus of the embodiment shown in FIG. 12 is employed, after the kneading apparatus 1 has been pierced into ground to be improved, a hardener is supplied from the lower injection opening 80 in the kneading zone 23 and the bottom portion of the soil layer to be improved is sufficiently kneaded and hardened. While the kneading apparatus 1 is drawn up, the hardener is supplied from the upper injection opening 82 and the lower portion of the soil layer is subjected to the hardening treatment. Accordingly, in the present invention, such a large power as required in the case where the hardening treatment is carried out while the kneading apparatus 1 is pierced in the ground is quite unnecessary for drawing up the kneading apparatus 1.

One embodiment of the improving ground by using the kneading apparatus of the present invention will now be described.

Figure 13:
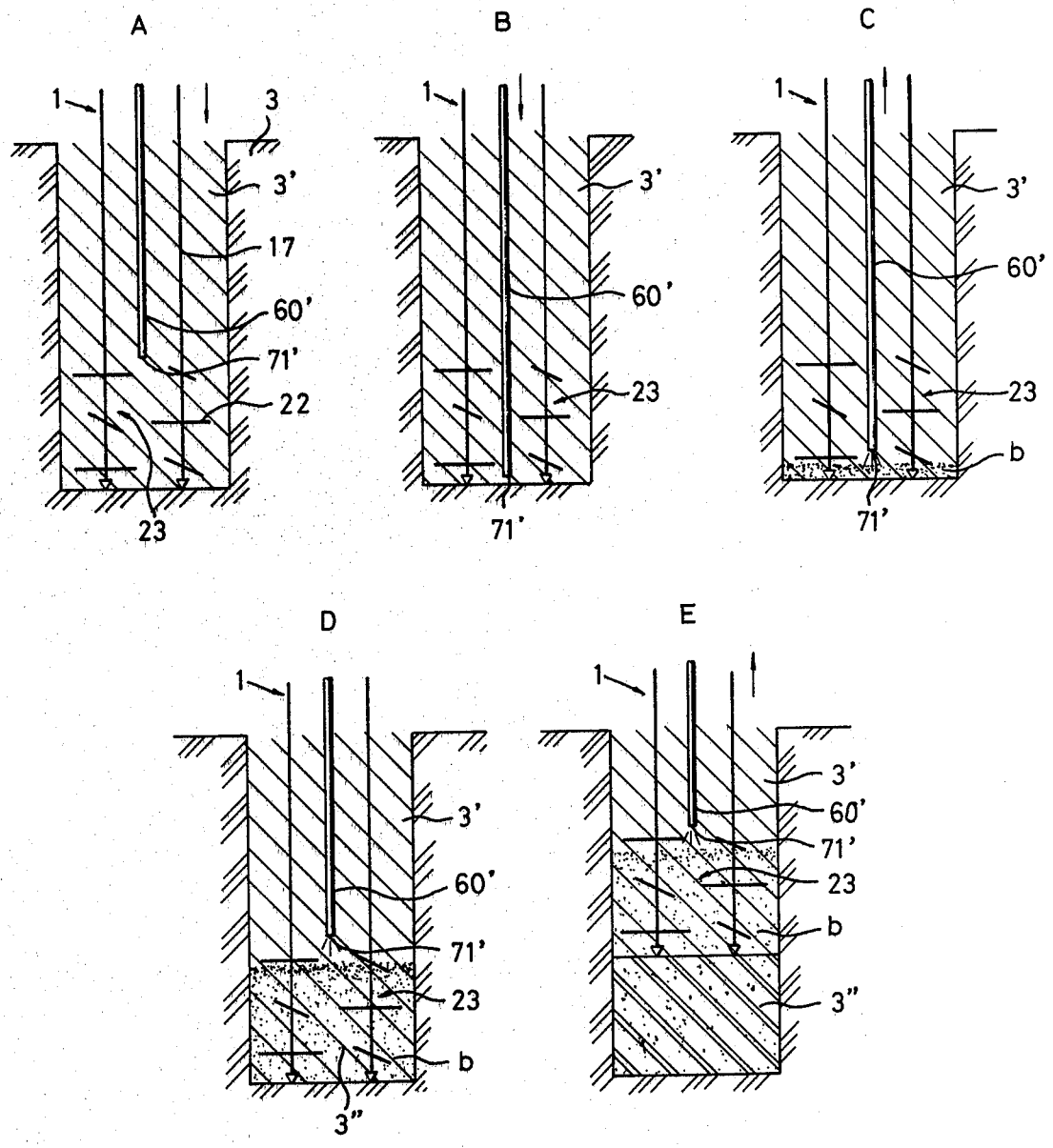
FIGS. 13-(A) to 13-(E) and FIGS. 14-(A) to 14-(D) are diagrams illustrating methods for hardening ground by using the kneading apparatus of the present invention.

In the kneading apparatus 1 used, a hardener injection tube 60' is vertically movable along at least a length corresponding to the length of the kneading zone 23 in the vertical direction. More specifically, a kneading apparatus as shown in FIG. 10 is employed. In the first place, as shown in FIG. 13-A, the kneading apparatus 1 is pierced into a soft ground 3 along a prescribed depth under rotation and agitation to disturb a soft soil layer 3' to be improved. At this point, the injection tube 61' is held at the elevated position and injection of a hardener is not effected. Then, the agitation by the kneading apparatus 1 is stopped and the injection tube 60' is brought down until an injection opening 71' of the injection tube 60' is located in the lower portion of the kneading zone 23 as shown in FIG. 13-B, and while the injection tube 60' is being lifted up, the hardener *b* is injected into the kneading zone 23 (see FIG. 13-C). In this manner, the injection tube 60' is lifted up to the upper portion of the kneading zone 23 and feeding of the hardener is stopped. In practising this method, if the kneading apparatus 1 shown in FIG. 10 is employed, the hardening agent is fed along a spiral course as pointed out hereinbefore. Then, the kneading apparatus 1 is driven at the position indicated in FIG. 13-D to perform sufficient kneading of the soil layer and the hardener, whereby the lower end portion 3'' of the soil layer is improved (hardened). After completion of the treatment of the lower end portion 3'', while the injection opening 71' is located above the kneading zone 23 as shown in FIG. 13-E, the operation of drawing up the kneading apparatus 1 is started and simultaneously, injection of the hardener *b* into the kneading zone 23 is started. In this manner, the soil layer is kneaded and improved up to the top end thereof.

Another embodiment of the ground improving method using the kneading apparatus of the present invention will now be described by reference to FIGS. 14-A to 14-D.

As in the case of the kneading apparatus as shown in FIG. 12, injection openings 80 and 82 are formed in the upper and lower portions of the kneading zone 23, respectively, and the feeding position of a hardener is changed over to the upper position or lower position by a change-over device. In the first place, the kneading apparatus 1 is pierced into a soft ground to be improved while agitating a soft soil layer 3' of the ground, and when the kneading apparatus 1 is pierced to a point where a bottom portion of the soil layer 3' along a length corresponding to the length of the kneading zone 23 is left in the non-pierced state, injection of a hardener *b* from the lower injection opening 80 into the lower end portion 3'' of the soft soil layer is started (see FIG. 14-A). In this state, the kneading apparatus 1 is pierced to the bottom of the soft soil layer to knead the soft soil sufficiently with the hardener to effect the hardening treatment of the lower portion of the soft soil layer. After this hardening treatment of the lower end portion 3'' of the soft soil layer, draw-up of the kneading apparatus 1 is started, and the hardener supply position is changed over by the change-over device, so that supply of the hardener from the lower injection opening 80 is stopped and supply of the hardener from the upper injection opening 82 is initiated (see FIG. 14-B). While the hardener is being fed from the injection opening 82, the kneading apparatus 1 is drawn up with the soft soil being agitated and kneaded with the hardener by the rotation of the agitation spindle 17. In this manner, the soil layer is subjected to the hardening treatment even up to the upper end portion thereof.

Figure 14:
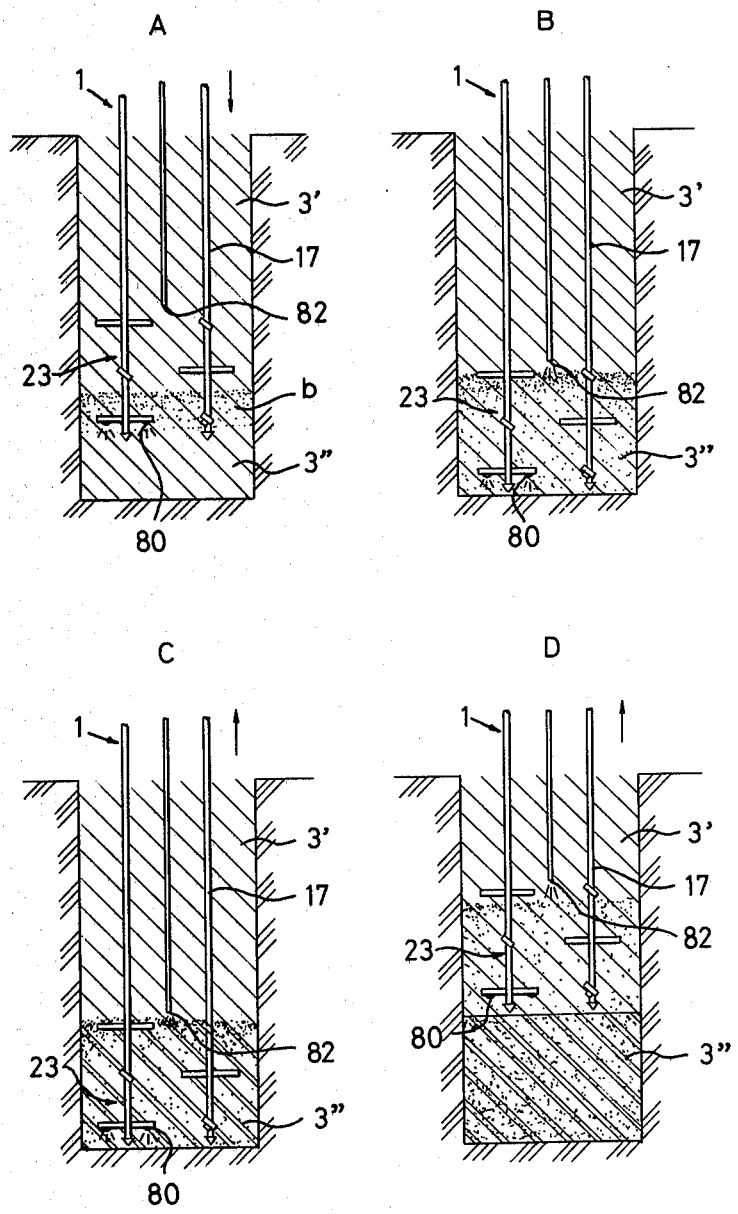

According to the ground improving methods illustrated in FIGS. 13-A to 13-E and FIGS. 14-A to 14-D, the lower end portion of the soil layer to be improved is first hardened and improved, and other remaining portion is then hardened and improved while the kneading apparatus is being drawn up. Therefore, the entire soil layer from the bottom to the top can be hardened and improved so that a sufficient strength is attained in the entire layer. Further, since the soil layer other than the lower end portion is kneaded and hardened while the kneading apparatus is being drawn up and hardening is not yet started in the soil layer when the kneading apparatus is drawn up, no large power is required for drawing up the kneading apparatus or performing the kneading operation.

Figure 15:
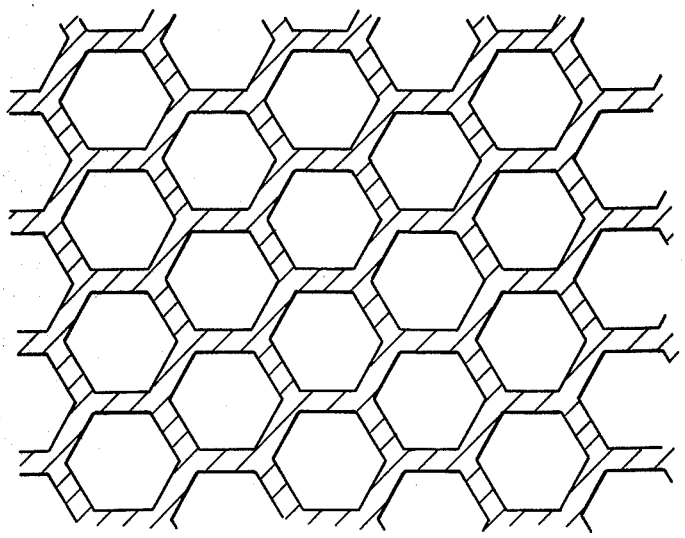
FIGS. 15-(A) to 15-(D) are plan views showing the sections of soil layers hardened according to the respective embodiments of the present invention.
Figure 15:
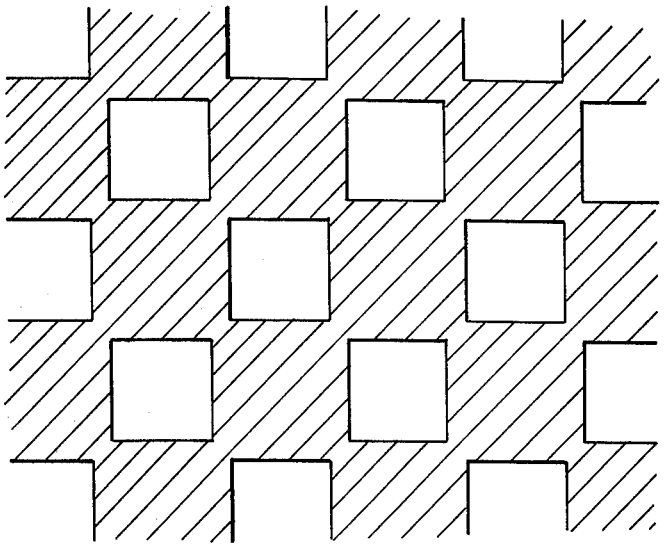
Figure 15:
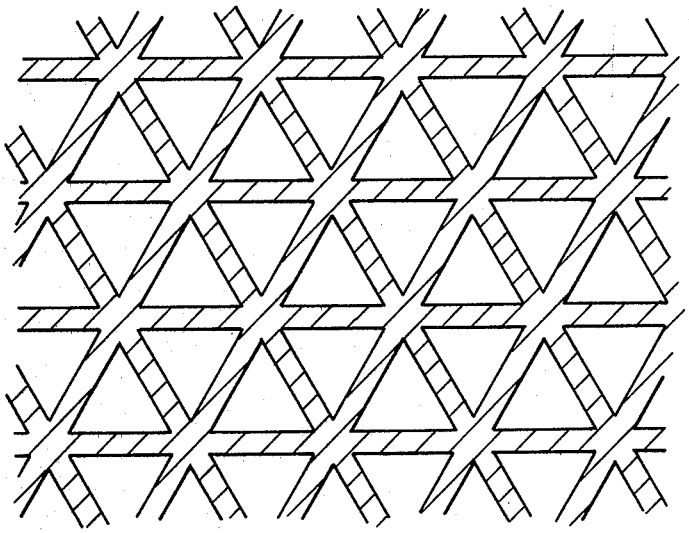
Figure 15:
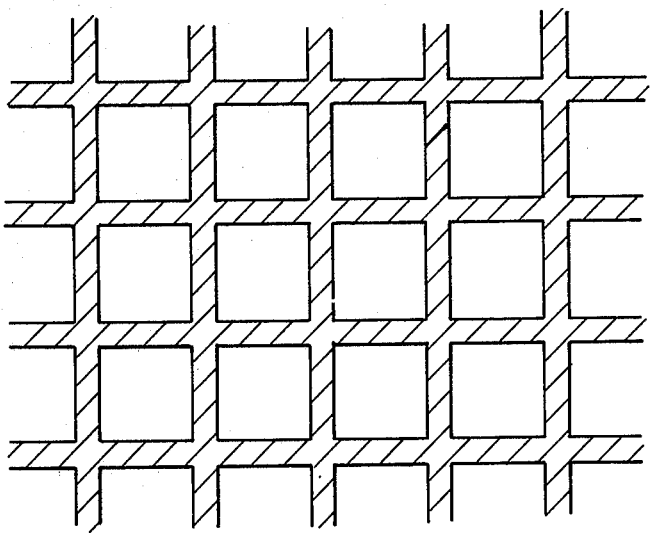

In each of the foregoing embodiments, four agitation spindles are set in one group, and these groups of the agitation spindles are continuously arranged to form a wall-like hardened soil structure or a stake-like hardened soil structure is formed by only one group of the agitation spindles. In addition, these groups of the agitation spindles may be arranged in a Y-shaped or square configuration, and hardened soil structures as shown in FIGS. 15-A to 15-D can be conveniently formed. Incidentally, FIGS. 15-A to 15-D are plan views showing sections of hardened soil structures formed by using the kneading apparatus of the present invention as illustrated in the foregoing embodiments.

What is claimed is:

1. A method for improving ground by using a kneading apparatus comprising a plurality of agitation spindles disposed in parallel to one another for agitating and kneading soft soil layers and the like, agitation vanes attached to the lower portion of each agitation spindle to form a kneading zone and means for feeding a hardener selectively to the upper portion or the lower portion of said kneading zones, said method comprising piercing said agitating apparatus into a ground to be improved along a desired depth while preliminarily disturbing a soil layer of the ground, injecting and supplying the hardener to said kneading zone of the agitation spindle, agitating and kneading soft soil with the hardener to thereby harden and improve the lower portion of the soil layer to be improved, then drawing up the kneading apparatus and injecting and supplying the hardener above the kneading zone while the kneading apparatus is being drawn up, to thereby harden and improve the preliminarily disturbed soil layer entirely up to the top end thereof.

2. A ground improving method according to claim 1 wherein said step of injecting the hardener in the kneading zone includes the step of forcing the hardener through an injection tube, said drawing up step includes moving the injection tube vertically to an elevated position, and said step of injecting hardener above the kneading zone includes the step of forcing hardener through the injection tube when the injection tube is located at the elevated position.

3. A ground improving method according to claim 1 wherein said step of supplying the hardener above the kneading zone includes the step of forcing the hardener through an injection tube and said step of supplying the hardener into the lower portion of the kneading zone includes the step of forcing the hardener through a hollow interior portion of the spindle to the kneading zone.

4. A multiple spindle kneading apparatus for improving ground, comprising:

a plurality of parallel agitation spindles;

a rotating and driving mechanism connected to said agitation spindles for synchronously rotating said spindles to agitate and knead soft soil layers and the like, said mechanism including a reduction gear, said spindles being arranged in groups of four spindles, the four spindles of each group being disposed at different corners of a square, said mechanism rotating adjacent spindles in opposite directions;

a plurality of agitation vanes attached to the lower portion of each of said agitation spindles to form a kneading zone in the soft soil;

means for injecting hardener into said kneading zone; and reinforcing members rotatably supporting said spindles;

whereby shaking of the spindles while they are rotating is prevented.

5. A multiple spindle type ground-improving kneading apparatus according to claim 4, wherein every four agitation spindles in each group are supported rotatably and equidistantly on the periphery of a cylindrical reinforcing member, and the cylindrical reinforcing members for respective groups of the agitation spindles are connected to one another by connecting members.

6. A multiple spindle type ground-improving kneading apparatus according to claim 4, wherein projecting excavating cutters are mounted on the lower end of each agitation spindle and blade-like excavation cutters are attached to the agitation spindle between said agitation vanes and said projecting excavating cutters.

7. A multiple spindle type ground-improving kneading apparatus according to claim 4, wherein each agitation spindle is formed to have a hollow structure, a passage for the hardener is formed in the interior hollow portion of the spindle, the top end of the hollow spindle is connected to a hardener supply source and a hardener injection opening is formed in the lower portion of the hollow spindle.

8. A multiple spindle kneading apparatus for improving ground, comprising:

a plurality of parallel agitation spindles arranged in groups of four spindles;

reinforcing members rotatably supporting said spindles;

connecting members connecting said reinforcing members together;

rotating and driving means connected to said spindles for rotating said spindles to agitate and knead soft soil layers and the like;

a plurality of agitation vanes attached to the lower portion of each of said agitation spindles to form a kneading zone in the soft soil;

at least one hardener injection tube adjacent each group of agitation spindles, a top end of said tube being connected to a hardener supply source;

a hardener injection opening in a lower portion of said tube; and tube driving and rotating means for moving said injection tube in a vertical direction and for rotating said tube.

9. A multiple spindle kneading apparatus as claimed in claim 8, wherein one of said injection tubes is located at the center of each of said groups of four spindles.

10. A multiple spindle kneading apparatus as claimed in claim 8 wherein the agitation vanes of adjacent ones of the four spindles in each of said groups overlap and four of said injection tubes are provided for each of said groups, said hardener openings being positioned where said vanes overlap.

11. A multiple spindle kneading apparatus as claimed in claim 8 wherein:

said agitation spindles are hollow and include a hardener passage therethrough, the top of said passage being connected to said hardener supply source;

a hardener supply opening is formed in said spindles at a lower portion of said kneading zone; and said hardener injecting openings in said injection tubes are positioned at an upper portion of said kneading zone;

said apparatus further comprising a changeover device for selectively supplying hardener through said injection tubes to an upper portion of said kneading zone or through said spindles to a lower portion of said kneading zone.

* * * * *